US005459992A

United States Patent [19]

Tsuzuki

[11] Patent Number: 5,459,992

[45] Date of Patent: Oct. 24, 1995

[54] SYSTEM FOR REGULATING MOISTURE CONTENT IN SLIVER TO BE FED TO SPINNING FRAME

[75] Inventor: Kiyohiro Tsuzuki, Nagoya, Japan

[73] Assignee: Tsuzuki Spinning Co., Ltd., Aichi, Japan

[21] Appl. No.: 211,108

[22] PCT Filed: Aug. 7, 1992

[86] PCT No.: PCT/JP92/01018

§ 371 Date: Mar. 21, 1994

§ 102(e) Date: Mar. 21, 1994

[87] PCT Pub. No.: WO94/03663

PCT Pub. Date: Feb. 17, 1994

[51] Int. Cl.[6] ..... D01H 13/04

[52] U.S. Cl. ..... 57/308; 57/90

[58] Field of Search ..... 57/90, 315, 75, 57/308

[56] References Cited

U.S. PATENT DOCUMENTS

| | | | |
|---|---|---|---|
| 3,070,949 | 1/1963 | Tsuzuki | 57/308 |
| 3,073,106 | 1/1963 | Tsuzuki | 57/308 |
| 3,191,375 | 6/1965 | Naegeli | 57/315 X |
| 3,469,385 | 9/1969 | Tsuzuki | 57/308 |
| 3,564,829 | 2/1971 | Tsuzuki | 57/308 |
| 3,816,991 | 6/1974 | Takeuchi et al. | 57/90 |
| 4,022,007 | 5/1977 | Motobayashi et al. | 57/90 X |
| 4,359,007 | 9/1982 | Gasser et al. | 57/308 X |
| 5,195,314 | 3/1993 | Stahlecker et al. | 57/90 X |
| 5,333,440 | 8/1994 | Tsuzuki | 57/315 |

FOREIGN PATENT DOCUMENTS

| | | | |
|---|---|---|---|
| 4100618 | 7/1992 | Germany | 57/90 |
| 4111000 | 10/1992 | Germany | 57/90 |
| 44-22775 | 9/1969 | Japan . | |
| 3-174032 | 7/1991 | Japan . | |

*Primary Examiner*—Joseph J. Hail, III,
*Attorney, Agent, or Firm*—Davis Hoxie Faithfull & Hapgood

[57] ABSTRACT

In a system for feeding slivers from an aging room to a spinning frame room through tubes, a simple method is proposed, capable of maintaining a moisture content of sliver at a predetermined value even though the meandering state of sliver in the tube varies in accordance with the change of the operational conditions. A spinning frame room (1) and a sliver-aging room (5) are respectively provided on the first and second floors so that a sliver (8) is fed, through a tube (10) communicating both the rooms with each other, into a drafting mechanism (3) of a spinning frame installed in the spinning frame room (1). Air pressure in the aging room (5) is controlled to be higher than that in the spinning frame room (1) so that a downward air stream always generates in the tube (10) from the aging room (5) to the spinning frame room (1). An air-through aperture (9) with a damper (11) for adjusting an opening degree thereof is provided between the aging room (5) and the spinning frame room (1).

4 Claims, 4 Drawing Sheets

SYSTEM FOR REGULATING MOISTURE CONTENT IN SLIVER TO BE FED TO SPINNING FRAME

TECHNICAL FIELD

The present invention relates to a method for regulating a moisture content in a sliver to a value suitable for the drafting operation in a spinning frame.

BACKGROUND OF THE INVENTION

In a spinning mill, a spun yarn is produced by drafting a sliver with a drafting mechanism provided in a spinning frame to be a desired thickness and twisting the same with a spindle.

Fibers preferably contain a suitable amount of moisture in order to smoothly carry out the drafting operation in the drafting mechanism while suppressing the generation of flies. On the other hand, it is said that a low humidity environment is favorable for the purpose of reducing the friction between a ring and a traveller during the twisting operation so that yarn breakages are minimized due to the lowering of spinning tension.

Accordingly, it is preferable that, prior to introducing into a spinning frame room air-conditioned to be a relatively dry environment to maintain a favorable spinning condition, slivers contained in cans are stored for a predetermined period in an aging room conditioned to be a higher humidity environment relative to that of the spinning frame room and then loaded to the spinning frame to be spun into yarns. Moisture in the sliver, however, is dispersed while being placed for a long time in the spinning frame room after being loaded to the spinning frame, whereby the sliver in a dry condition is fed to the drafting mechanism and prevented from being smoothly drafted.

As one of countermeasures for solving the above problem, the present applicant proposed a system, in Japanese Patent Publication (Kokoku) No. 44-22775, in which a sliver-aging room and a spinning frame room are respectively provided upstairs and downstairs and air-conditioned independently from each other; a sliver is guided through a long tube to a drafting mechanism of a spinning frame in the downstairs spinning frame room conditioned at relatively high temperature and low humidity, from a can placed in the aging room conditioned at relatively low temperature and high humidity (hereinafter referred to as a "separation system"). According to this system, since the sliver is conveyed to the spinning frame while being tightly sealed within the tube, the sliver is prevented from losing moisture during passage.

In the separation system, air in the spinning frame room is maintained at a relatively high temperature so that the relative humidity becomes low, while air in the aging room is maintained at a relatively low temperature. In addition, air pressure in the spinning frame room is slightly lower than that in the aging room. The reason for this is that, if the pressure relationship were reversed, the high temperature air in the spinning frame room would go up the tube for guiding the sliver into the aging room where it is cooled to condense on the innerwall of tube as a dew. The dew condensation must be absolutely avoided because it obstructs the smooth advancement of sliver and results in the sliver breakage or other problems.

Therefore, according to this system, air pressure is controlled so that an air stream always generates in the tube, flowing in one direction from the upstairs aging room to the downstairs spinning frame room.

During the passage through the tube, the sliver moisture is gradually dispersed due to the descending air stream and the temperature rise to be a content (in a range of about 6.8% through 8.0% in a case of cotton) suitable for the drafting operation when the sliver reaches the drafting mechanism of the spinning frame.

The dehydration degree of the sliver in the tube varies in accordance with the change of flow rate of downward air stream in the tube; if the flow rate is more, the moisture dispersion is accelerated to cause a dry sliver; on the other hand, if the flow rate is less, the moist state is maintained. Further, the flow rate also varies in accordance with the change of sliver filling degree in the tube; if the filling degree is higher, the flow rate decreases due to the increase of flow resistance; on the other hand, if the filling degree is lower, the flow rate increases due to the reduction of flow resistance.

The filling degree in the tube corresponds to a meandering state of sliver in the tube, and should be controlled at a stage of mill design to be a predetermined value while taking the operational conditions into account, by selecting a proper material and inner diameter of tube.

If the meandering state of sliver changes as shown in FIGS. 3(*a*) and 3(*b*) in accordance with the variation of operational condition such as a sliver weight in unit length or of frictional coefficient of tube inner wall, the dehydration degree of sliver also changes, whereby the sliver of predetermined moisture content cannot be fed to the spinning frame.

An object of the present invention is to provide a simple method capable of maintaining a moisture content in sliver at a constant value even though a meandering state of sliver in a tube varies while corresponding to the variation of operational conditions.

DISCLOSURE OF THE INVENTION

This object can be achieved by a system for feeding a sliver to a spinning frame, in which a sliver is introduced into a drafting mechanism of the spinning frame installed in a downstairs spinning frame room from an upstairs aging room for sliver through a tube communicating both the rooms, characterized in that an air pressure in the aging room is maintained at a higher value than that of the spinning frame room so that an air stream always flows down through the tube from the aging room to the spinning frame room, and in that an air-through aperture is provided between the aging room and the spinning frame room, having a damper capable of controlling an opening degree of the aperture.

Air flowing into the spinning frame room from the aging room goes down through the respective tube communicating both the rooms and through the air-through aperture. Under the normal operational conditions, flow resistances therein are defined to be a proper ratio so that a predetermined flow rate is obtained in the respective tube. When the meandering state of sliver in the tube varies, however, a steady state maintained in the system is disturbed whereby the flow rate of air passing through the tube as well as the dehydration of the sliver are changed.

To prevent such an inconvenience, according to the present invention, the opening degree of the aperture is adjusted by the damper in accordance with the variation of flow resistance in the tube so that the ratio of flow resistance between the aperture and the tubes is maintained at the predetermined value. That is, if the sliver filling degree increases to increase the flow resistance, the air-through aperture is narrowed and, on the contrary, if the sliver filling degree falls to reduce the flow resistance, the aperture is widened. Thereby, even if the sliver filling degree in the tube varies, a flow rate of the air stream going down through the tube is unchanged, whereby the sliver having a constant moisture content can be fed to the spinning frame.

BRIEF DESCRIPTION OF THE DRAWINGS

The present invention will be described in more detail with reference to the preferred embodiments illustrated in the attached drawings: wherein.

BEST MODE FOR CARRYING OUT THE INVENTION

Figure 1:
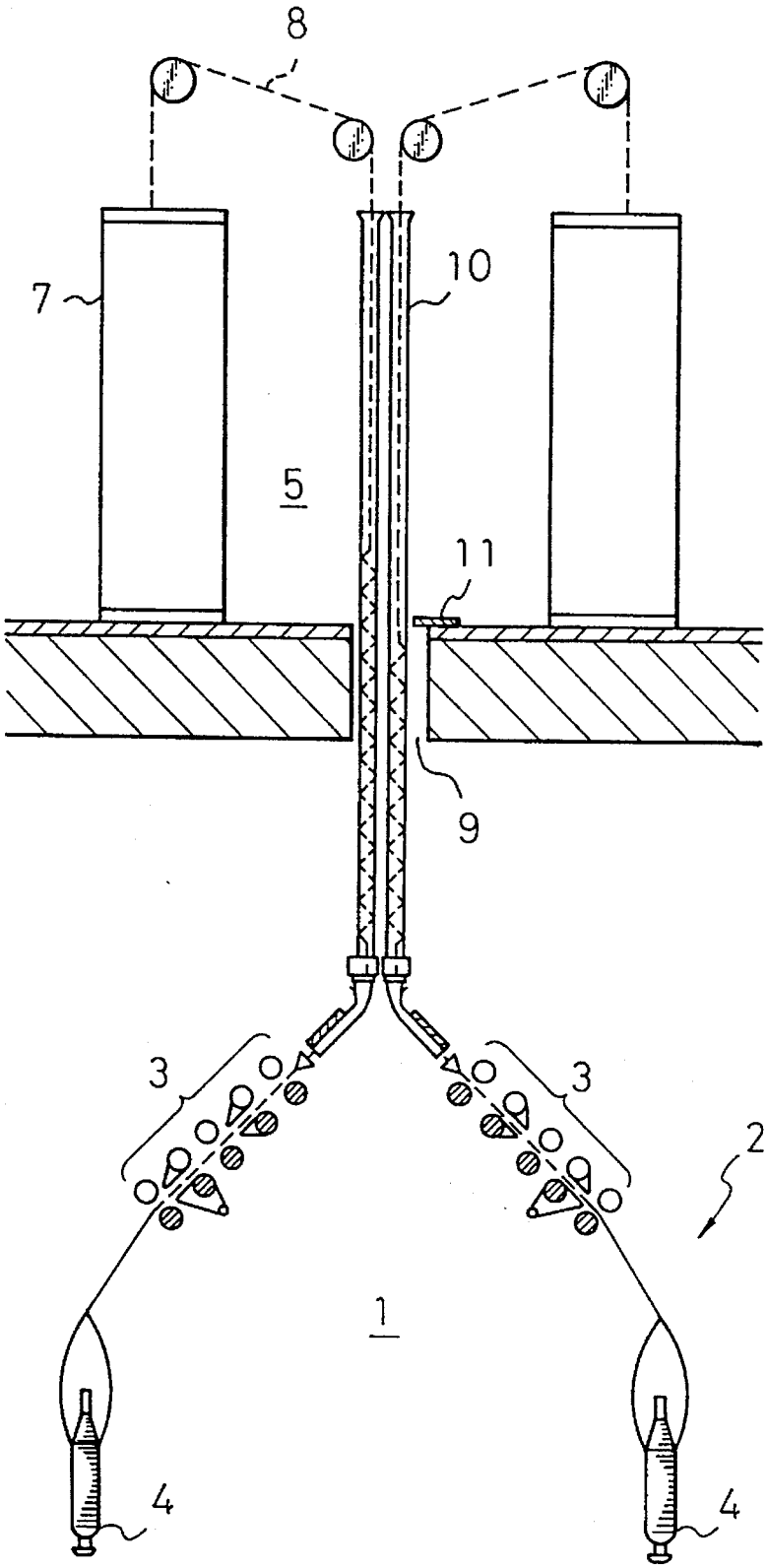
FIG. 1 is a schematic view of a machine layout in a spinning mill according to a system of the present invention.

FIG. 1 is a schematic side view illustrating a spinning frame room and an aging room to which the sliver feeding system according to the present invention is applied.

In the downstairs spinning frame room 1, a plurality of spinning frames 2 are arranged. In the drawing, however, only one of them is illustrated, in which a plurality of spinning units, each consisting of a drafting mechanism 3 and a spindle 4, are disposed in a side-by-side manner along the respective side of the machine frame. Interior of the spinning frame room is air-conditioned to be a relatively high temperature in a range of 32° C. through 35° C. and a low relative humidity in a range of 38% through 43%.

The upstairs aging room 5 is air-conditioned to be a relatively low temperature in a range of 23° C. through 26° C. and a high relative humidity in a range of 66% through 74%, so that a sliver 8 contained in a can 7 stored in the aging room maintains a suitable moisture content (in a range of 6.8% through 8.0% in a case of cotton) when the sliver reaches the drafting mechanism 3 of the spinning frame.

A gap (an air-through aperture) 9 is provided on a floor of the aging room 5, through which a plurality of tubes 10 extend downstairs substantially in the vertical direction to an inlet of the drafting mechanism 3 of the downstairs spinning frame 2.

As described before, in order to prevent the dew condensation due to the rise of high temperature air from the spinning frame room side to the aging room side, an air pressure in the aging room is maintained slightly higher than that in the spinning frame room. Accordingly a downward air stream always flows through the gap 9 and the tubes 10.

One of the features of the present invention is that an opening degree of gap 9 is adjustable. That is, as shown in FIG. 2, a damper 11 is provided on the floor of the aging room 5 to cover part of the gap 9 while being movable back and forth in the horizontal direction.

The operation of this damper 11 is to regulate a flow rate of air flowing into the spinning frame room 1 from the aging room 5 through the gap 9. That is, air flows from the aging room 5 maintained at a higher pressure to the spinning frame room 1 maintained at a lower pressure through the gap 9 and the respective tubes 10. In an ideal state, the sliver 8 in the tube 10 is dehydrated by the evaporation of part of the moisture contained in the sliver during the displacement from the low temperature zone to the high temperature zone while being exposed to the downward air stream and introduced in the drafting mechanism of the spinning frame with the abovesaid proper moisture content. The dehydration degree of sliver varies in accordance with the flow rate of air flown through the tube; i.e., the more the flow rate, the more the dehydration degree.

Figure 3A:
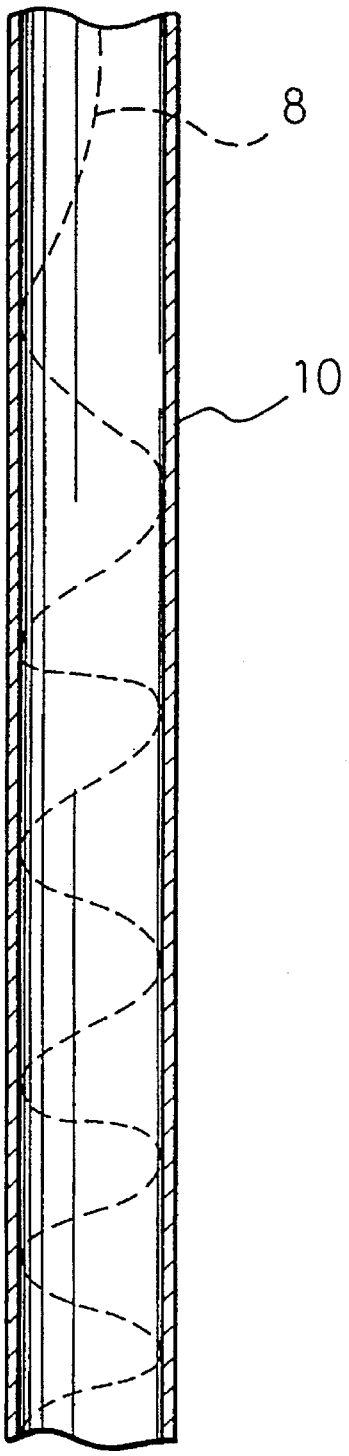
FIGS. 3(*a*) and 3(*b*) are schematic views showing meandering states of sliver in a tube.
Figure 3B:
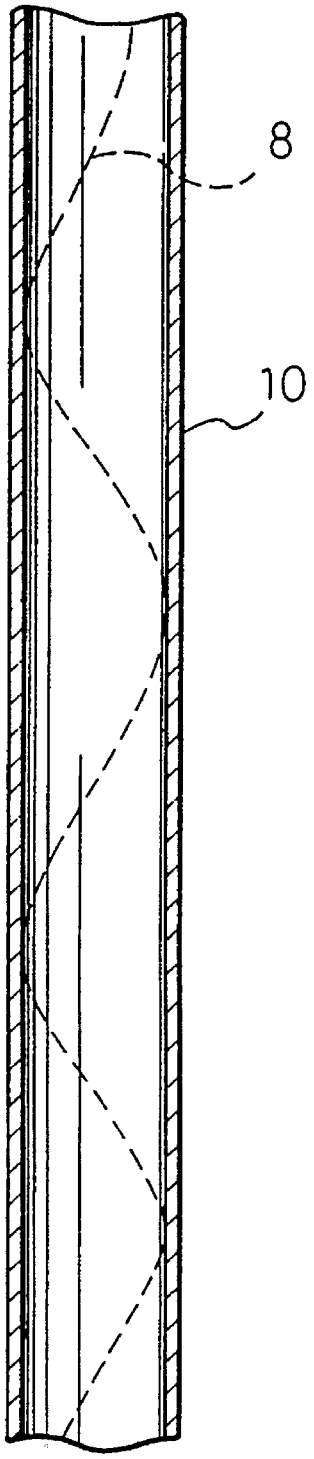
Figure 4:
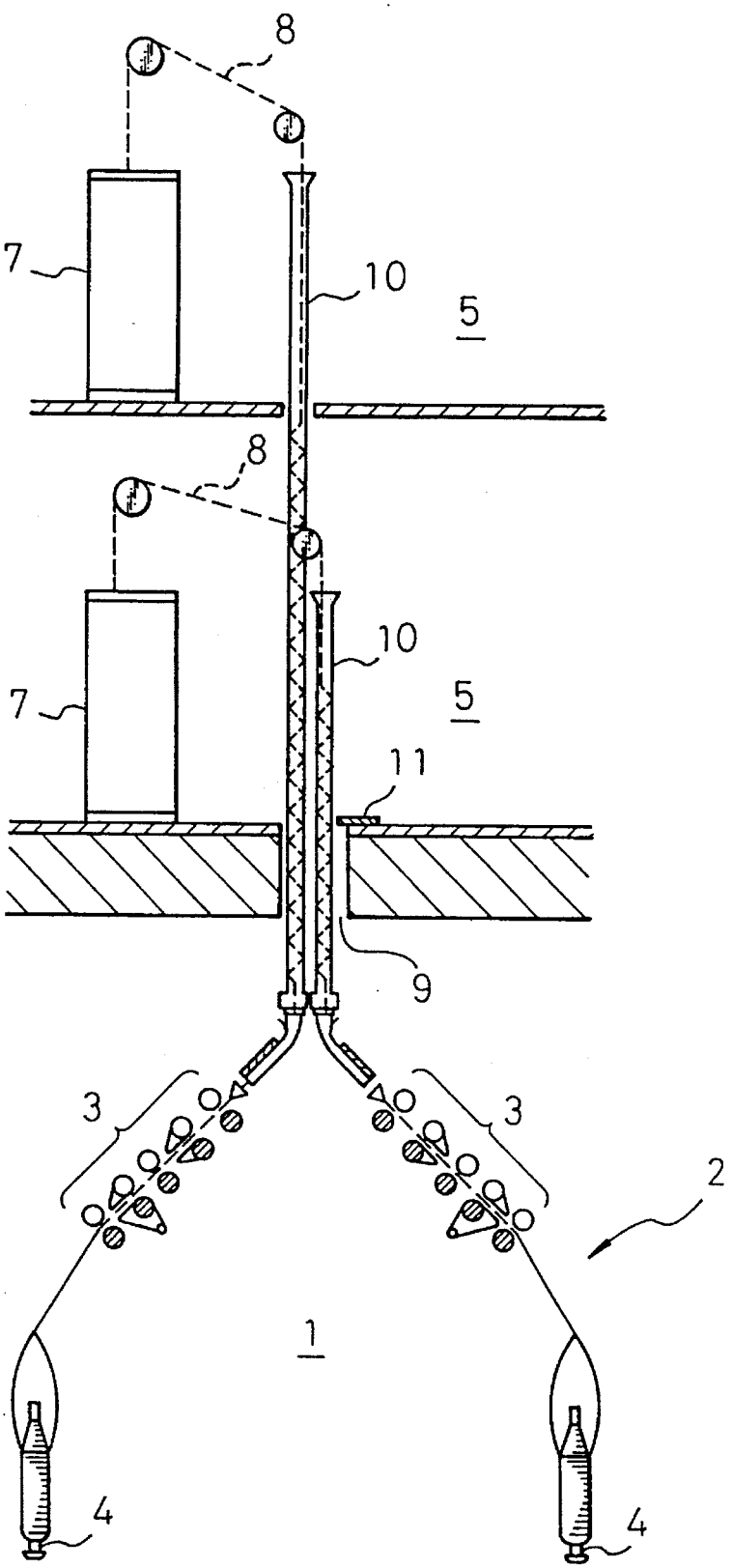
FIG. 4 is a schematic view showing another embodiment in which the present invention is applied to a spinning mill having aging rooms in second and third floors.

As described before, as shown in FIGS. 3(*a*) and 3(*b*), the sliver descends through the tube in a meandering manner due to a balance between a self weight and a frictional resistance to the inner wall of the tube. If the meandering state changes, for example, from the state shown in FIG. 3(*a*) to that shown in FIG. 3(*b*), in accordance with the variation of operational conditions, the flow resistance decreases due to the reduction of filling degree of sliver, resulting in the increase of flow rate of air passing the respective tube. As a result, the smooth spinning operation cannot be expected because the excessively dehydrated dry sliver is fed to the spinning frame.

Figure 2A:
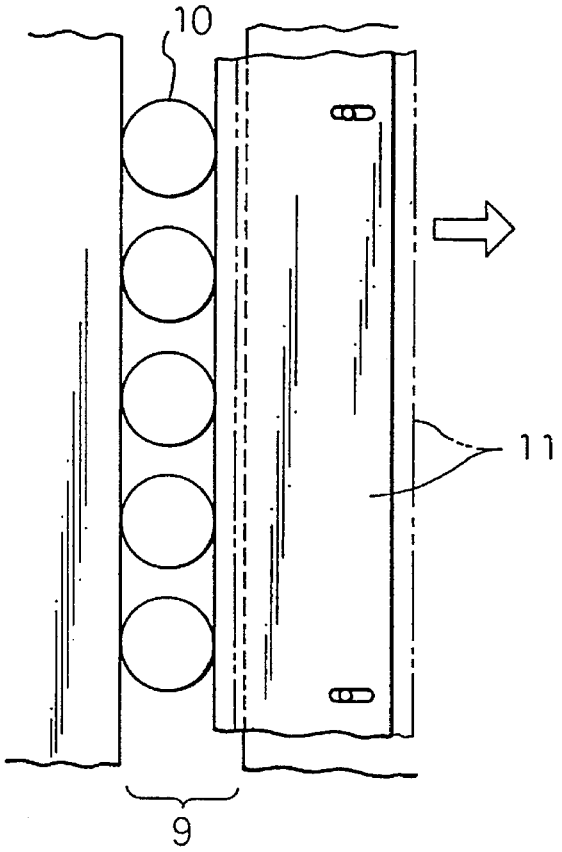
FIGS. 2(*a*) and 2(*b*) are a plan view and a side view, respectively, illustrating an air-through aperture having a damper used in the present invention.
Figure 2B:
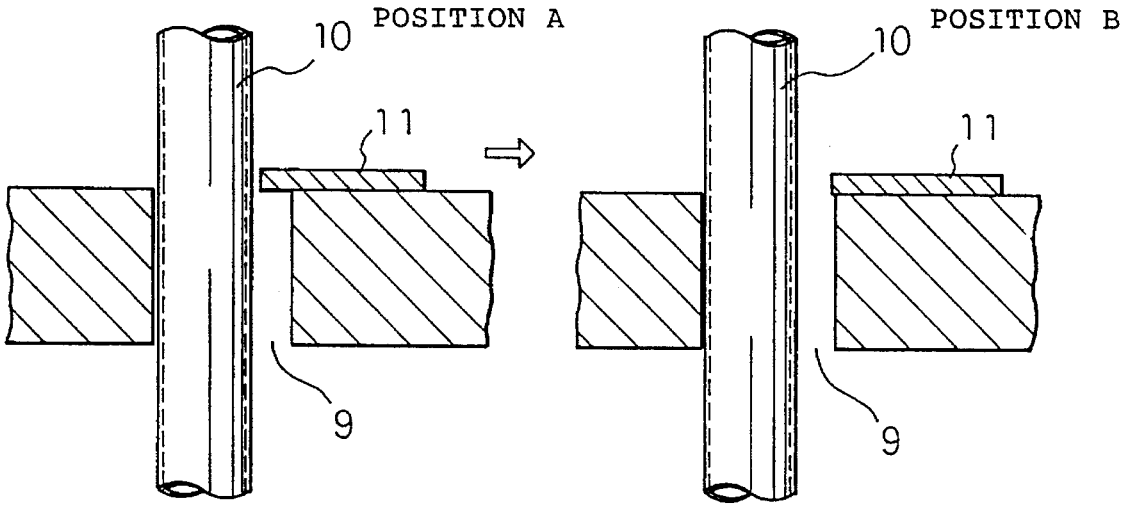

According to the present invention, the damper 11 is moved from a position shown by a solid line to a position B shown by a chain line as shown in FIG. 2(*a*) to uncover part of gap 9 covered with damper 11 to increase an opening area of gap 9, as shown in the right hand part of FIG. 2(*b*). Since the flow resistance of gap 9 reduces thereby, air can easily flow therethrough and, as a result, the flow rate of air passing the respective tube 10 decreases.

According to the present invention, it is possible to always balance the flow resistance in the gap with that in the tube by adjusting the damper 11 to vary the opening area of gap 9. Thus, even if a sliver filling degree in the tube varies, it is possible to maintain a flow rate of air passing the tube at a predetermined value and always feed a sliver having a desired moisture content to the spinning frame.

Although the aging room is provided only on the second floor in the above embodiment, the present invention should not be limited only to this aspect but may include a system in which the aging room is provided both on the second and third floors.

Capability of Exploitation in Industry

As described hereinbefore, the system according to the present invention is suitable for feeding slivers having proper moisture content to spinning frames in a spinning mill so that the smooth drafting operation can be conducted.

I claim:

1. A system for feeding a sliver to a spinning frame, in which a sliver is introduced into a drafting mechanism of the spinning frame installed in a downstairs spinning frame room from an upstairs aging room for sliver through a tube communicating both the rooms, comprising means for maintaining an air pressure in the aging room at a higher value than that of the spinning frame room so that in operation an air stream always flows down through the tube from the aging room to the spinning frame room, and further comprising an air-through aperture outside said tube which is provided between the aging room and the spinning frame room, having a damper capable of controlling an opening degree of the aperture.

2. A sliver feeding system as defined by claim 1, wherein first air conditioning means maintain the air in the aging room at a temperature in a range of 23° C. through 26° C. and a relative humidity in a range of 66% through 74%, and second air conditioning means maintain the air in the spinning frame room at a temperature in a range of 32° C. through 35° C. and a relative humidity in a range of 38% through 43%.

3. A sliver feeding system as defined by claim 1, wherein the aging room is provided on the second floor.

4. A sliver feeding system as defined by claim 1, wherein the aging room is provided both on the second and third floors.

* * * * *